United States Patent [19]

Stahel

[11] 3,976,328

[45] Aug. 24, 1976

[54] BABY CARRIER AND SEAT

[75] Inventor: Alwin J. Stahel, New Brighten, Minn.

[73] Assignee: Questor Corporation, Toledo, Ohio

[22] Filed: Oct. 6, 1975

[21] Appl. No.: 620,061

[52] U.S. Cl. ..... 297/377; 248/455

[51] Int. Cl.[2] ..... A47D 1/00

[58] Field of Search ..... 297/377, 344, 366, 372, 297/364; 248/454, 455, 456

[56] References Cited

UNITED STATES PATENTS

| | | | |
|---|---|---|---|
| 2,158,453 | 5/1939 | Wood | 297/372 |
| 2,702,909 | 3/1955 | Atkins | 297/377 |
| 3,101,972 | 8/1963 | Laughlin | 297/377 |
| 3,272,556 | 9/1966 | Rocker | 297/377 |
| 3,302,970 | 2/1967 | Rizzato | 297/195 |
| 3,409,325 | 11/1968 | Hamilton et al. | 297/377 |

*Primary Examiner*—Roy D. Frazier
*Assistant Examiner*—Darrell Marquette
*Attorney, Agent, or Firm*—Donald R. Bahr; John E. Benoit

[57] ABSTRACT

A combination baby carrier and seat comprising a molded doublewalled shell including a seat and a back. A rigid support structure is pivotally connected to the shell. An arcuate integral section below the seat has gear teeth on the outer circumference thereof and a longitudinal slot down the center. A roll extends slidably through said support structure and said slot and is connected at the outer end to a handle. The handle has teeth which mate with any selected section of the gear teeth on the arcuate section. A spring between the other end of the rod and the support structure biases the handle into contact with the arcuate section. Positioning of the handle controls the angular position of the support structure.

5 Claims, 4 Drawing Figures

56
67
21
11
17
57
59
19
15
33
39
31
25
29
51
49
27

21
15
3.
39
33
13
19
53
31
41
17
23
35
55
3.

BABY CARRIER AND SEAT

The present invention relates generally to baby carriers and more specifically to a double walled integrally molded carrier having an attached adjustable tubular stand.

Various types of baby chairs are available which are designed to support infants in a plurality of reclining positions. While some of these chairs are light enough to be moved with the infant from place to place, they are not designed so that the baby may be comfortably carried any distance. Additionally, the adjustable mechanisms are sometimes unecessarily complicated and subject to malfunction.

It is an object of the present invention to provide a baby chair which also is a convenient baby carrier.

A further object of this invention is to provide a lightweight baby chair and carrier which includes a stand with simple adjusting means to vary the reclining position when used as a chair.

These and other objects of the invention will become apparent from the following description when taken in conjunction with the drawings wherein FIG. 1 is a perspective view of a preferred embodiment of the present invention;

Broadly speaking, the invention relates to a combination baby carrier and seat comprising a molded doublewalled shell including a seat and a back. A rigid support structure is pivotally connected to the shell. An arcuate integral section below the seat has gear teeth on the outer circumference thereof and a longitudinal slot down the center. A rod extends slidably through said support structure and said slot and is connected at the outer end to a handle. The handle has teeth which mate with any selected section of the gear teeth on the arcuate section. A spring between the other end of the rod and the support structure biases the handle into contact with the arcuate section. Positioning of the handle controls the angular position of the support structure.

Figure 1:
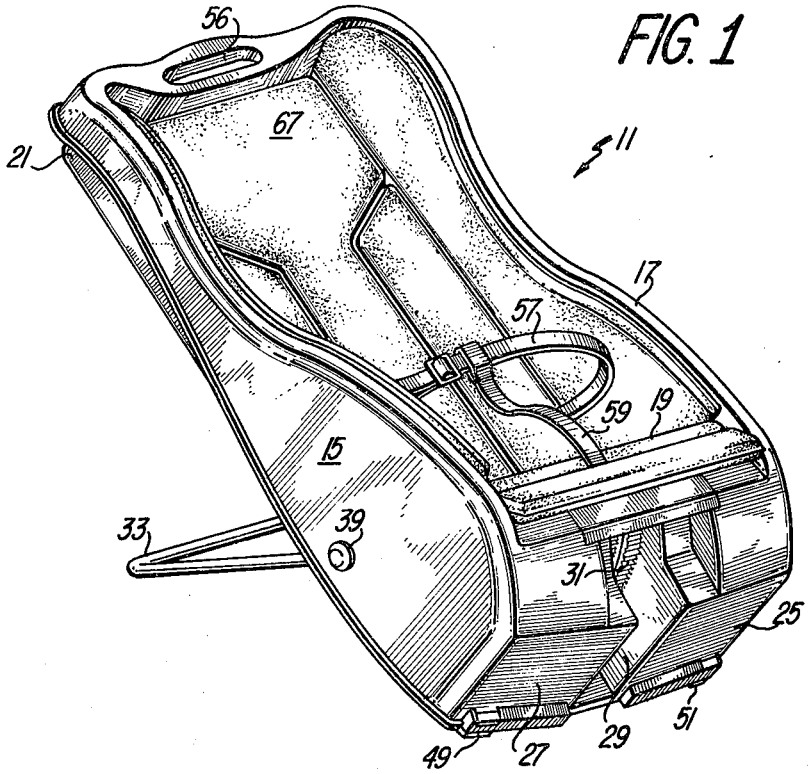
Figure 2:
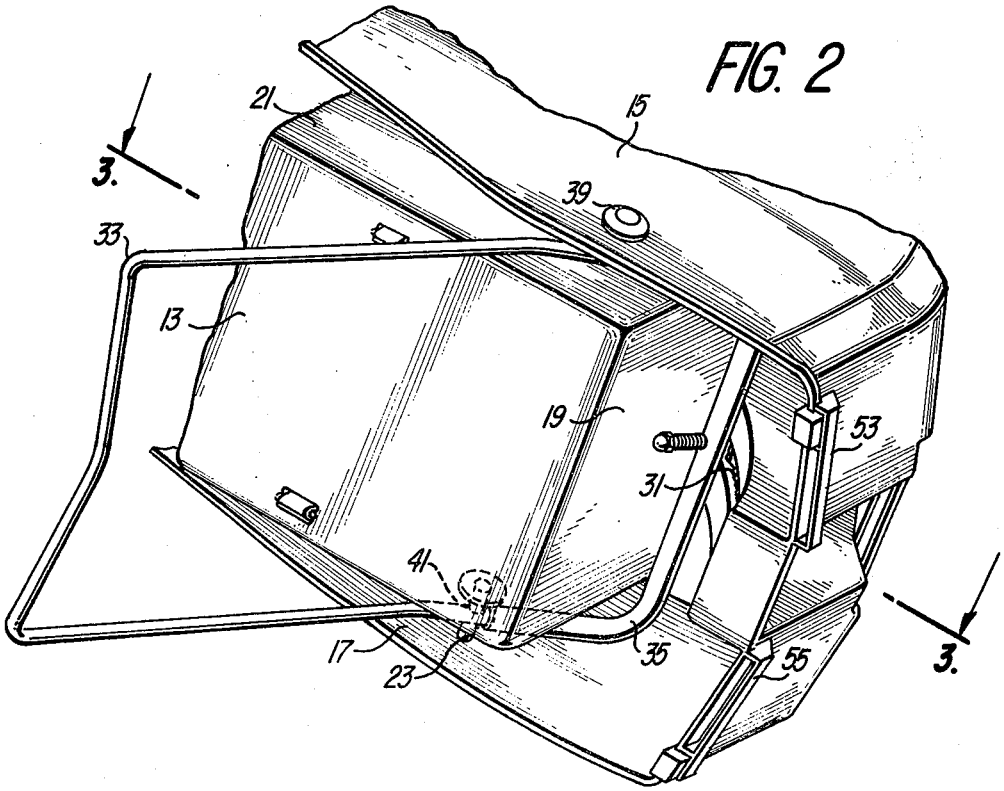
FIG. 2 is a partial perspective view of the underside of the carrier of FIG. 1.

Turning now more specifically to the drawings, and with reference to all of the Figs., there is shown a molded baby carrier and seat 11 having a back 13 (FIG. 2), two outer sides 15 and 17, and a seat 19. As indicated in FIG. 2, there are also integral inner sides 21 and 23 which, in effect, provides a double-walled construction.

Below the seat 19 is a further integral structure comprising opposed hollow sections 25 and 27 separated by a channel 29. The inner face of channel 29 terminates in an arcuate face having gear teeth 31.

The entire structure described above is molded from a plastic so as to form a unitary shell.

A rectangular support structure comprises two V-shaped rigid tubular members 33 and 35 mated. The rectangular support structure is pivotally secured to the molded shell at pivot points 37 by means of pins 39 and 41 which extend through both walls and are secured thereto by any standard means.

Figure 3:
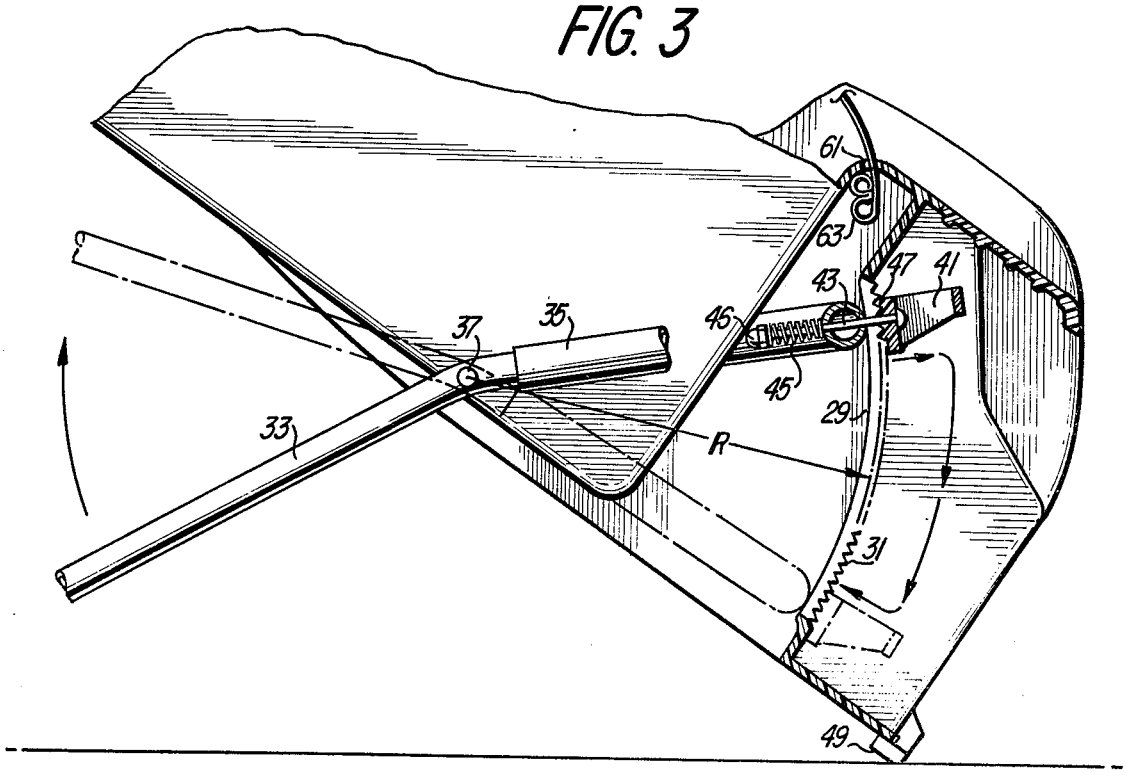
FIG. 3 is an elevational view, partially in section, of the carrier of FIG. 1.

A rod 43 extends slidably through the inner section of tubular member 35 and is secured at its outer end to a handle 41. Rod 43 extends inwardly of tubular member and terminates with a nut 46 at its inner end. A spring 45 fits about rod 43 between tubular member 35 and nut 46. The spring is of such a length that it is under compression in the position shown in FIG. 3 so as to bias handle 41 against the gear teeth 31 of the arcuate section. The inner face of handle 41 has teeth which are of a configuration so as to mate with the gear teeth 31 on a selected portion of the arcuate section. The arcuate section is selected as an arc having a predetermined radius from pivot point 37.

Figure 4:
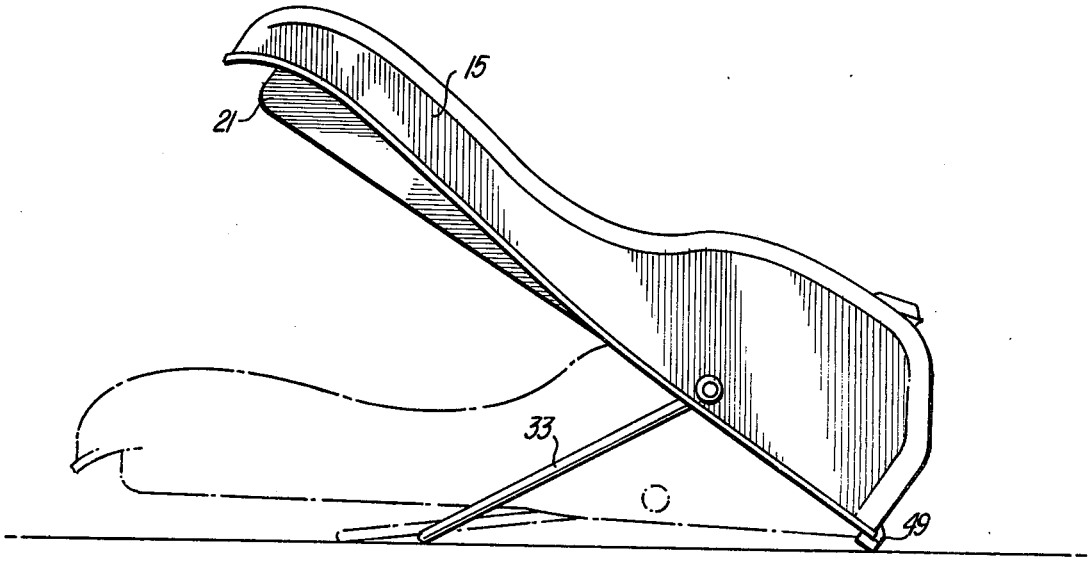
FIG. 4 is an illustrative elevational view of the variable positioning of carrier of FIG. 1.

In operation, when handle 41 is pulled so as to overcome the bias of spring 45, it may be moved along the arcuate section to any position desired and then released so as to lock it in that position due to the meshing of teeth 47 with gear teeth 31. Such movement of the handle will move the support structure about the pivot point. This allows the carrier to be placed at selected angles when used as a seat as illustrated in FIG. 4. The solid lines indicate the seat in a somewhat upright position while the dotted lines show the seat in a collapsed position.

In order to prevent the seat from sliding, it may also be equipped with soft plastic or rubber feet 49 and 51 placed in channels 53 and 55.

The seat is also equipped with a molded-in carrying handle 56. When the seat is used as a carrier, it is preferable to move the support to the position shown in dotted lines in FIG. 4.

The baby is restrained within the carrier by waist strap 57 secured to the back of the shell through slots (not shown) and crotch strap 59 extending between the waist strap and through slot 61. Strap 59 is retrained within the slot by excess loops 63 which are glued together as shown.

A removable pad 67 fits within the seat and may be constructed of a vacuum-formed vinyl and die cut polyurethane foam.

It will be apparent that the present invention provides a compact unitary structure which may be used as a carrier or a seat. The structure is light in weight and economical to manufacture. Further it is easily adjustable when used as a seat.

The above description and drawings are illustrative only. Accordingly the invention is to be limited only by the scope of the following claims.

I claim:

1. A combination baby carrier and seat comprising a molded plastic shell having a back, first sides and a seat;

a second pair of integral sides spaced from said first sides so as to form a double side wall;

a substantially rectangular rigid stand;

means for pivotally securing opposite sides of said rectangular rigid stand between said first and second sides;

said shell having an integral front section below said seat;

said shell having an integral arcuate section with a predetermined radius from the pivot axis of said stand;

gear teeth on the outer side of said arcuate section;

a slot extending longitudinally along said arcuate section;

a handle having teeth thereon of a geometrical configuration to mate with a section of said gear teeth;

a rod passing through the inner side of said rectangular stand and through said slot;

means for securing one end of said rod to said handle;

spring means about the other end of said rod for biasing said handle toward said arcuate section; and an integral handle through the upper back of said shell.

2. A combination baby carrier and seat comprising a molded double-walled shell including a seat and a back;

a rigid support stand pivotally connected to said shell;

said shell having an arcuate integral section below said seat and forward of said support stand; said arcuate section having a longitudinal slot therethrough;

gear teeth on the outer circumference of said arcuate section;

a handle having teeth thereon of a configuration to mate with a section of said gear teeth;

rod means slidably extending through said slot for connecting said handle to one end of said support stand;

means coupled to said rod means for biasing said handle against said arcuate section; and an integral handle through the upper back of said shell.

3. The carrier and seat of claim 2 wherein said rigid support stand comprises a tubular rectangular metal frame.

4. The carrier and seat of claim 2 wherein said means for biasing said handle comprises a spring between one end of said rod and said rigid support stand.

5. The carrier and seat of claim 2 wherein said arcuate section is an arc taken a predetermined radius from the pivot point of said support stand.

* * * * *